US007546721B2

(12) United States Patent
Rasile et al.

(10) Patent No.: US 7,546,721 B2
(45) Date of Patent: Jun. 16, 2009

(54) METHOD OF MAKING A TETRAHEDRON PACKAGE

(75) Inventors: William Rasile, Allison Park, PA (US); David Kuethe, Gibsonia, PA (US); Richard Hilenski, Round Hill, VA (US)

(73) Assignee: Heinz North America (a division of H.J. Heniz Company), Pittsburgh, PA (US)

( * ) Notice: Subject to any disclaimer, the term of this patent is extended or adjusted under 35 U.S.C. 154(b) by 0 days.

(21) Appl. No.: 11/976,334

(22) Filed: Oct. 23, 2007

(65) Prior Publication Data

US 2009/0100803 A1 Apr. 23, 2009

(51) Int. Cl.
*B65B 9/02* (2006.01)
*B31B 1/64* (2006.01)

(52) U.S. Cl. ..... 53/450; 53/133.3; 53/456; 493/189; 493/212; 493/295

(58) Field of Classification Search ..... 53/450, 53/456, 133.3, 133.6, 133.8; 493/189, 198, 493/212, 295, 296
See application file for complete search history.

(56) References Cited

U.S. PATENT DOCUMENTS 3,038,649 A 6/1962 Rausing
3,925,959 A * 12/1975 Dykes et al. ..... 53/451
3,955,335 A 5/1976 Yates, Jr.
4,067,170 A * 1/1978 Yates, Jr. ..... 53/451
4,268,531 A 5/1981 Whiting, Jr.
4,537,308 A 8/1985 Hollander, Jr.
4,727,707 A * 3/1988 Hadden ..... 53/451
5,158,499 A 10/1992 Guckenberger
5,213,867 A * 5/1993 Huston et al. ..... 428/126
5,220,771 A 6/1993 Burns
5,229,180 A 7/1993 Littmann
5,548,947 A * 8/1996 Fincham et al. ..... 53/551

(Continued)

FOREIGN PATENT DOCUMENTS

EP 473 517 A2 3/1992

(Continued)

OTHER PUBLICATIONS

Machine translation of European Patent- 0922652.*

*Primary Examiner*—Hemant M Desai
(74) *Attorney, Agent, or Firm*—Buchanan, Ingersoll & Rooney PC

(57) ABSTRACT

A method of making tetrahedron packages having substantially uniform tear zones is disclosed. The method includes printing a first image at a first location of a sheet material and a second image at a second location of the sheet material, such that the first image is oriented 180° from and longitudinally arranged with respect to the second image. A tube is formed from the sheet material. The tube runs through a package forming machine to form a first tetrahedron package including the first image and a second tetrahedron package including the second image from the tube. The first tetrahedron package and the second tetrahedron package are connected by a seal zone. Substantially uniform tear zones are formed in the seal zone using a laser or a knife. The substantially uniform tear zones are at the same location with respect to a side edge of the first and second tetrahedron packages.

22 Claims, 6 Drawing Sheets

U.S. PATENT DOCUMENTS 5,630,308 A 5/1997 Guckenberger
5,727,366 A * 3/1998 Manly, Jr. ..... 53/451
5,969,029 A 10/1999 Kotani et al.
6,119,439 A * 9/2000 Stevie ..... 53/455
6,685,058 B2 2/2004 Redmond
6,878,774 B2 4/2005 Kikuchi et al.
7,036,713 B2 5/2006 Lee
7,169,102 B2 * 1/2007 Bossel et al. ..... 493/189

FOREIGN PATENT DOCUMENTS

EP 0922652 * 12/1997

* cited by examiner

METHOD OF MAKING A TETRAHEDRON PACKAGE

BACKGROUND

Tetrahedron packages and methods of making are known. Typically, the tetrahedron packages are formed on form, fill and seal apparatus. A method of making tetrahedron packages with substantially uniformly positioned tear zones is desirable.

SUMMARY

Provided is a method of making tetrahedron packages having substantially uniform tear zones. The method includes printing a first image at first location of a sheet material and a second image at a second location of the sheet material, such that the first image is oriented 180° from and longitudinally arranged with respect to the second image. The first image and the second image are also adjacent one another. The images can be pre-printed or printed when the packages are formed.

A tube having a longitudinal seam running the length thereof is formed from the sheet material. The longitudinal seam can be a fin seal or an overlap seal.

A first tetrahedron package including the first image and a second tetrahedron package including the second image are formed from the tube, such that the first tetrahedron package and the second tetrahedron package are connected by a seal zone. In an embodiment, the seal zone is horizontal in relation to the formation of the tube. The seal zone is scored with a laser prior to forming the package or serrated with a knife after the package is formed to form the substantially uniform tear zones in the first tetrahedron package and the second tetrahedron package. When serrated, the tear zone includes notches that can act as a tab. In an embodiment, the substantially uniform tear zones may be arcuate. In other embodiments, the tear zones may be straight or angled. The substantially uniform tear zones are at the same location with respect to a side edge of the first tetrahedron package and a side edge of the second tetrahedron package.

Preferably, the sheet material includes a foil and a plastic material. The plastic material is selected from the group consisting of oriented polypropylene film, low density polyethylene, polyethylene terephthalate and combinations thereof. Preferably, the foil is aluminum foil.

The substantially uniform tear zone is about 8 mm to about 20 mm from the side edge of the first tetrahedron package and the second tetrahedron package. In another embodiment, the substantially uniform tear zone is about 8 mm to about 15 mm from the edge of the first tetrahedron package and the second tetrahedron package.

A knife may be used to score the second seal zone. The knife may have staggered teeth. Alternatively, a laser may be used to score the second seal zone.

In another embodiment, a method of making tetrahedron packages having substantially uniform tear zones includes printing indicia at first location and at a second location along a sheet material to form a first image and a second image, such that the first image is oriented about 180° from and longitudinally arranged with respect to the second image, forming a tube from the sheet of material, feeding said tube through a package forming apparatus, forming a first seal zone in the tube below the first image to form a first sealed tube; loading the sealed tube with a product; forming a second seal zone in the sealed tube above a location of the product and above the first image to form a first tetrahedron package and a second sealed tube, loading the second sealed tube with the product, forming a third seal zone in the sealed tube above a location of the product and above the second image to form a second tetrahedron package, and scoring the second seal zone to form substantially uniform tear zones in the first tetrahedron package and the second tetrahedron package. The substantially uniform tear zone of the first tetrahedron package and the substantially uniform tear zone of the second tetrahedron package are at the same location with respect to an edge of the second seal zone.

Preferably, the first seal zone, the second seal zone, and the third seal zone are heat seals. The second seal zone is oriented about 90° from the first seal zone. The third seal zone is oriented about 90° from the second seal zone.

The substantially uniform tear zone of the first tetrahedron package and the substantially uniform tear zone of the second tetrahedron package can be arcuate. The apex of the arcuate substantially uniform tear zone is about 8 mm to about 20 mm from the edge of the first tetrahedron package and the second tetrahedron package. Alternatively, the apex of the substantially uniform tear zone is about 8 mm to about 15 mm from the edge of the first tetrahedron package and the second tetrahedron package.

Also provided is a knife for scoring a material. The knife includes teeth. Preferably, at least two of the teeth are misaligned such that the knife forms notches that can act as tabs.

DETAILED DESCRIPTION

A method of making tetrahedron packages having substantially uniform tear zones is described herein.

Figure 1:
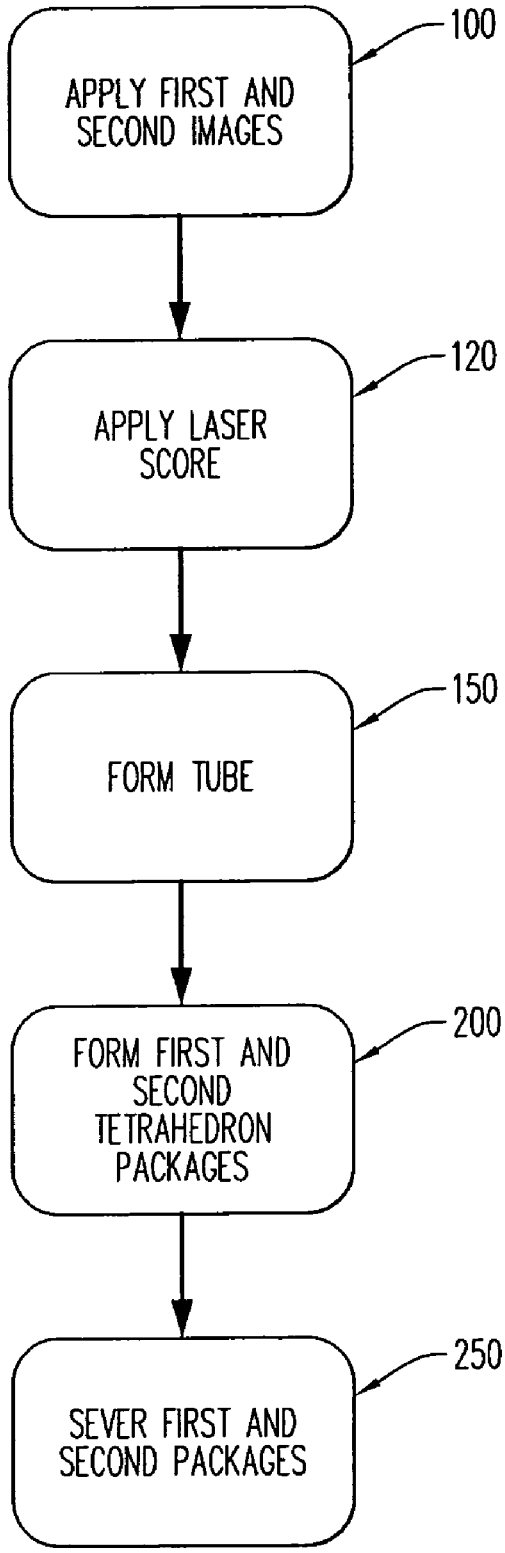
FIG. 1 is a schematic illustration of an embodiment of a method of making tetrahedron packages having substantially uniform tear zones.

In an embodiment, as shown in FIG. 1, the method includes printing at least a first image and a second image 100 at spaced apart locations on a sheet material. Preferably, the first image is oriented about 180° from and longitudinally arranged with respect to the second image. Also, the first image may be adjacent to the second image. The first image is located on the sheet material such that the first image can be incorporated in a first package and the second image can be incorporated in a second package. A seal zone may lie between the first image and the second image. Additional images can be formed in pairs in which each image of the pair is oriented about 180° from the other image. The first image and the second image can be printed at the same or at different times. The images can be preprinted or printed when the packages are formed.

Once the sheet material is printed, the sheet material is formed into a tube 150. The tube may include a longitudinal seam running the length of the tube. In an embodiment, instead of printing the sheet material, the tube can be printed. In a preferred embodiment, the longitudinal seam is a fin seal. In an alternative embodiment, the longitudinal seam may be an overlap seal. For example, an overlap seal may be used when the sheet material includes a first sealant layer, a layer of polypropylene, a layer of foil and a second sealant layer.

The sheet material used to form the tube may be a substrate containing a plastic material and a foil material. The sheet material can include a plastic layer and a foil layer. Preferred materials for use in the sheet material are selected from the group consisting of oriented polypropylene, low density polyethylene, polyethylene terephthalate and combinations thereof. Polyethylene terephthalate is a preferred material because it provides sufficient rigidity to the finished tetrahedron package. Preferably, the sheet material is impermeable such that an enclosed product does not leak through the walls of the tetrahedron package. Most preferably, the sheet material is aluminum foil.

The tube of sheet material may be laser scored before or after printing. Preferably, the tube is scored between the first image and the second image in an area that is sized and configured to be the seal zone once tetrahedron packages are formed from the tube. The tube of sheet material can be scored prior to forming the packages.

Once formed, the tube is fed through a package forming apparatus to form at least a first and a second tetrahedron package 200. A first horizontal seal zone is made in the tube by a sealing element to form a first sealed tube. A measured amount of a desired product is then placed inside the first sealed tube. A second seal zone is made by the sealing element in the tube above the location of the product and above the location of the first image. Preferably, the second seal zone is oriented about 90° from the first seal zone so as to form a first tetrahedron package having the first image thereon. The second seal zone is also horizontal with respect to the formation of the tube.

The product can be a consumable product such as a condiment. Suitable condiments include, without limitation, ketchup, mayonnaise, mustard and relish.

Once formed, the second horizontal seal zone acts as a first horizontal seal zone for a second tetrahedron package and forms a second tube. A measured amount of the desired product is then placed in the second tube. A third horizontal seal zone is formed in the tube above the location of the desired product within the second tube and above the location of the second image. Preferably, the third horizontal seal zone is oriented about 90° from the second seal zone to form a second tetrahedron package having the second image thereon.

Once the first tetrahedron package and the second tetrahedron package are formed, the second seal zone lying between the two packages may have already been laser scored 120 to form substantially uniform tear zones. Thus the second seal zone is severed 250 to separate the first tetrahedron package from the second tetrahedron package.

If the tube has not been laser scored, a knife can form the tear zone in the seal zone. In this embodiment, once the second seal zone is formed, the knife can serrate the second seal zone such that the second seal zone is bisected and the first tetrahedron package is separated from the second tetrahedron package. The knife forms serrations or notches that can act as tabs to be pulled when opening the package.

If the tube is laser scored a knife can bisect the second seal zone to separate the first tetrahedron package from the second tetrahedron package.

Figure 3:
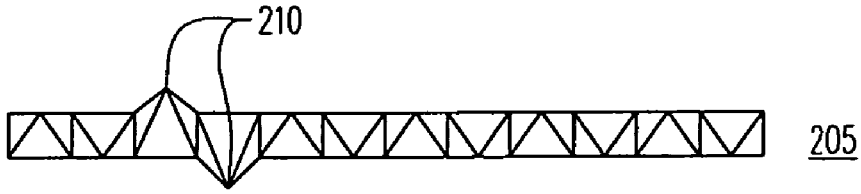
FIG. 3 is an illustration of a top view of an embodiment of a scoring knife having staggered teeth.
Figure 2:
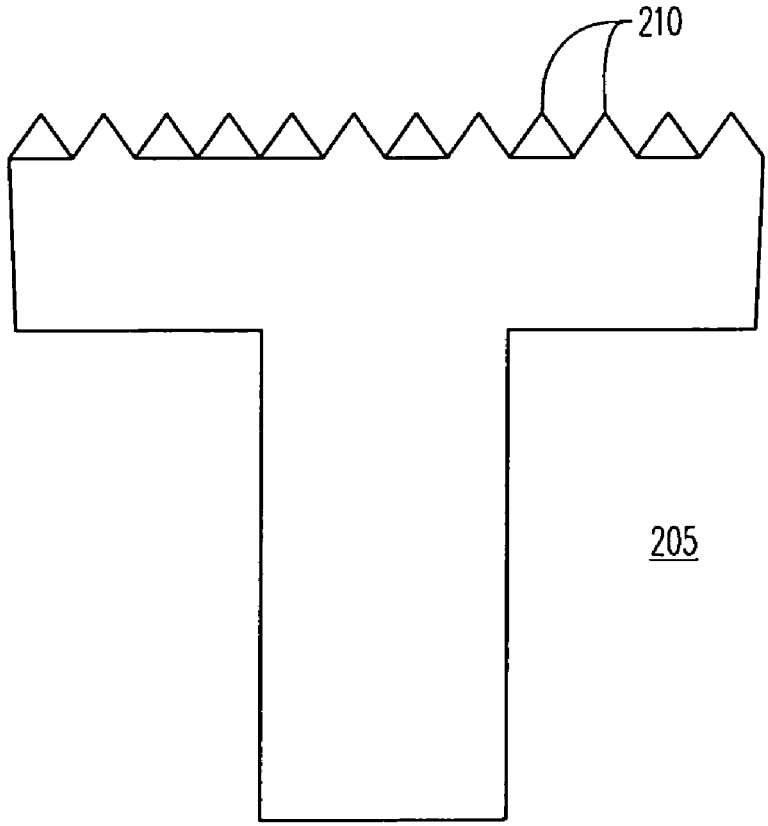
FIG. 2 is an illustration of an embodiment of scoring knife having staggered teeth.

As shown in FIGS. 2 and 3, the knife 205 can include staggered teeth 210. Preferably, the staggered teeth 210 can form at least two notches that are misaligned so that once the first tetrahedron package and the second tetrahedron package are bisected between the two misaligned notches, a tab is formed in the substantially uniform tear zone of each tetrahedron package. The tab can be used as a pull tab by the user to begin tearing the package at the substantially uniform tear zone.

Preferably, the teeth of the knife are spaced about 0.5 mm to about 2 mm apart. The teeth can be about 0.5 mm to about 5 mm in length.

Figure 4:
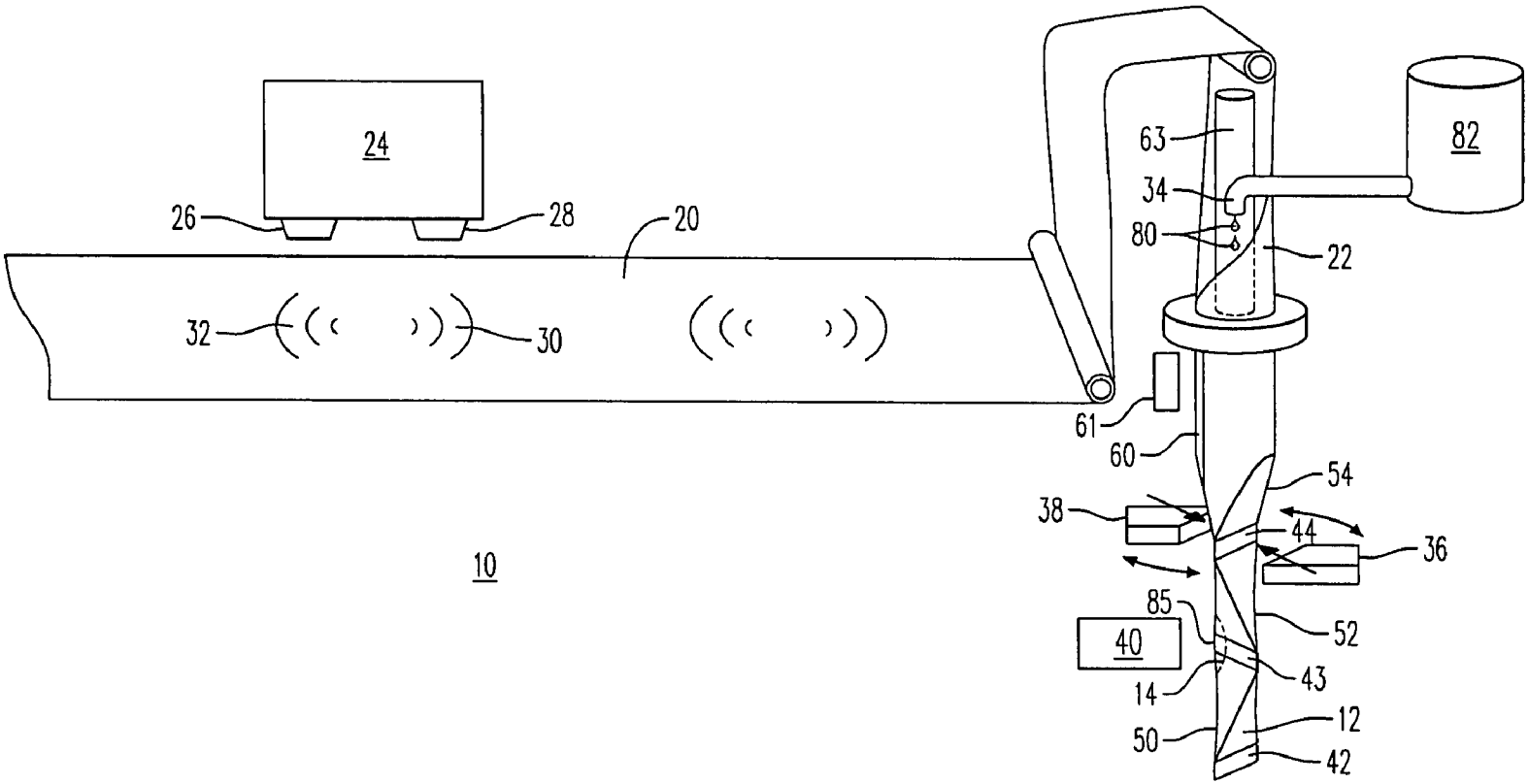
FIG. 4 is an illustration of an embodiment of an apparatus for making tetrahedron packages having substantially uniform tear zones.

As seen in FIG. 4, in an embodiment of the method of making tetrahedron packages having substantially uniform tear zones, a continuous package forming apparatus 10 forms the tetrahedron packages 12 having substantially uniform tear zones 14.

In a preferred embodiment, the sheet material 20, as described above, is printed at spaced apart locations by a printer 24 having a first printing nozzle 26 and a second printing nozzle 28. The first printing nozzle 26 prints the first image 30 and the second printing nozzle prints the second image 32 either simultaneously or consequentially. Preferably, the first image 30 is oriented about 180° from the second image 32. In another embodiment, a single printing nozzle can print each image at the same or at different times.

The first image 30 and the second image 32 are printed at angles so that when the packages are formed, the first image 30 is incorporated in a first package and the second image 32 is incorporated in a second package. Since the first and second packages share a common seal zone before separating the packages, a tear zone can be formed in both packages at once such that the tear zone is in a substantially uniform location with respect to a side edge of each package.

In an embodiment, the sheet material 20 is pre-printed and/or pre-scored. Pre-printing is preferred when a consumable product is loaded into the packages as formed so as to prevent contamination due to ink and the print curing process.

Figure 5:
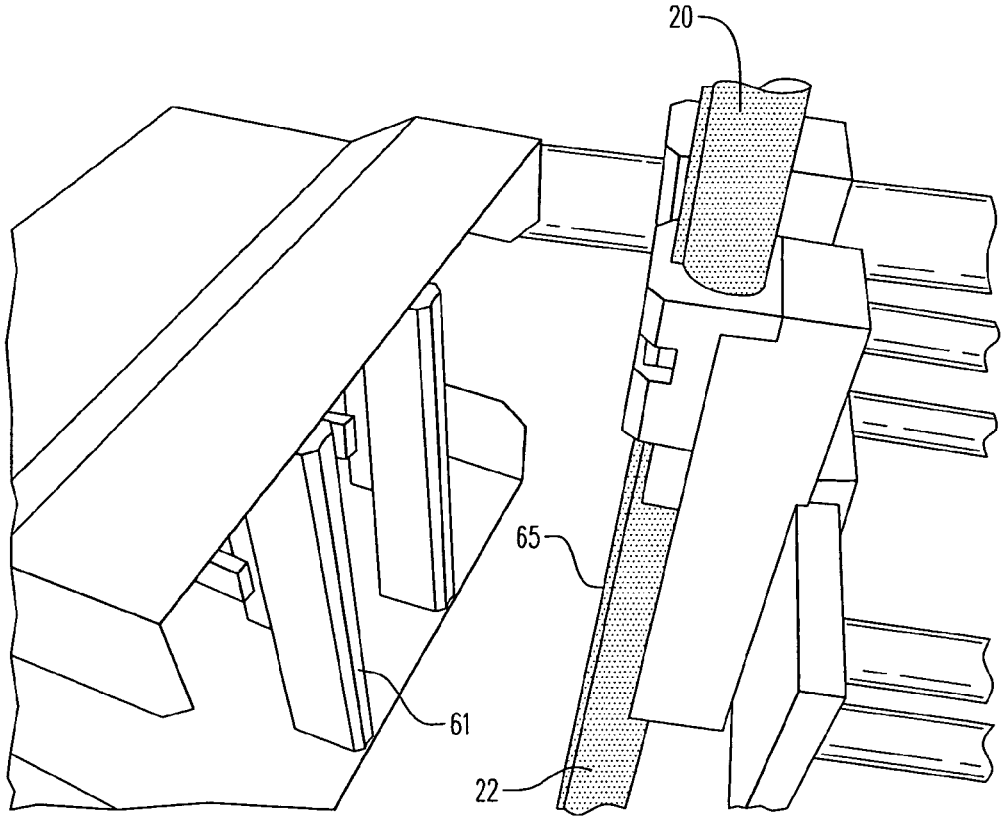
FIG. 5 is an illustration of a tube forming apparatus and longitudinal sealing element.
Figure 6:
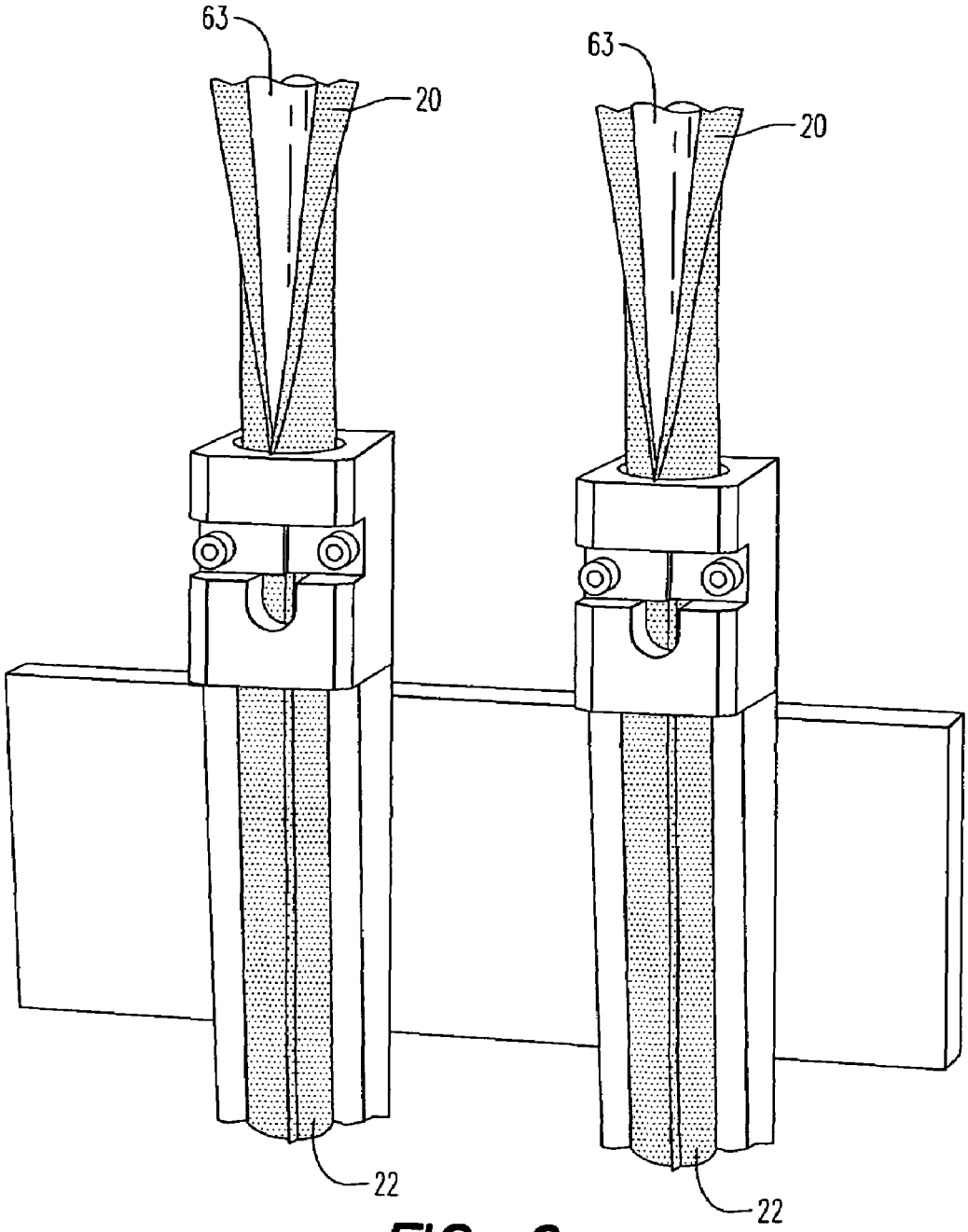
FIG. 6 is an illustration of a tube forming apparatus.

Preferably, the printed sheet material 20 is fed through the package forming apparatus 10 where the sheet material 20 is formed into a tube 22 having a longitudinal seam 60 that runs the length of the tube 22. The longitudinal seal is formed by a longitudinal sealing element 61, which seals the tube as it is formed around a tube forming apparatus 63. The sheet material 20 comes over the top of the tube forming apparatus 63 (also shown in FIG. 6) and begins to wrap around the tube forming apparatus 63. The tube 22 then passes through a seal alignment section 65 (shown in FIG. 5) and continues down the tube forming apparatus 63. The longitudinal sealing element 61 presses against the folded material of the tube 22 and applies heat and pressure thereto resulting in the formation of the longitudinal seal 60. The longitudinal seal 60 can be sealed using heat sealing, a polyethylene sealant, an adhesive, or other suitable sealing means. The longitudinal seal 60 can be a fin seal or an overlap seal.

As the tube 22 is fed through the apparatus 10, sealing elements 36, 38, which are horizontal in relation to the tube 22, seal the tube 22 at select locations to continuously form tetrahedron packages. Each seal zone is at about a 90° angle to the previous seal zone in the tube so as to form the tetrahedron shape.

Preferably, the sealing elements 36, 38 are heat sealers so that when the two layers of the tube 22 are pressed together and heat is applied, a seal zone is formed. In an embodiment, the sealing elements 36, 38 are heated by a resistance heater. In another embodiment, the sealing elements 36, 38 are heated by convection.

Preferably, the sealing elements 36, 38 seal the tube 22 to form a first seal zone 42 that is horizontal with respect to the direction of tube formation. Once the first seal zone 42 is formed, a product 80 may be loaded into the tube 22. The package forming apparatus 10 may include a hopper 82 that holds the product 80. A nozzle 34 descends from the hopper 82 to just above the open tube 22. The product 80 flows through the nozzle 34 to load the product 80 into the tube 22 above the first seal zone 42. Preferably, the package forming apparatus 10 is programmed to load a measured amount of the product 80 into the tube 22.

After loading the product 80 into the tube 22, a second seal zone 43 is formed in the tube 22 by the sealing elements 36, 38. Preferably, the second seal zone 43 is oriented about 90° from and longitudinally arranged with respect to the first seal zone 42 so as to form a first tetrahedron package 50. The second seal zone 43 is above the location of the product 80 in the tube and also above the location of the first image 30 so that the first image 30 is incorporated into the first tetrahedron package 50.

Once formed, the second seal zone 43 acts as the first seal zone for a second tetrahedron package. A measured amount of a product 80 is again loaded into the tube 22 such that the second seal zone 43 contains the product 80 within a second portion of the tube 22. Once the product 80 is loaded, a third seal zone 44 is formed in the tube 22 above the location of the product 80 and above the location of the second image 32. The third seal zone 44 is oriented about 90° from the second seal zone 43 so as to form a second tetrahedron package 52.

Figure 7:
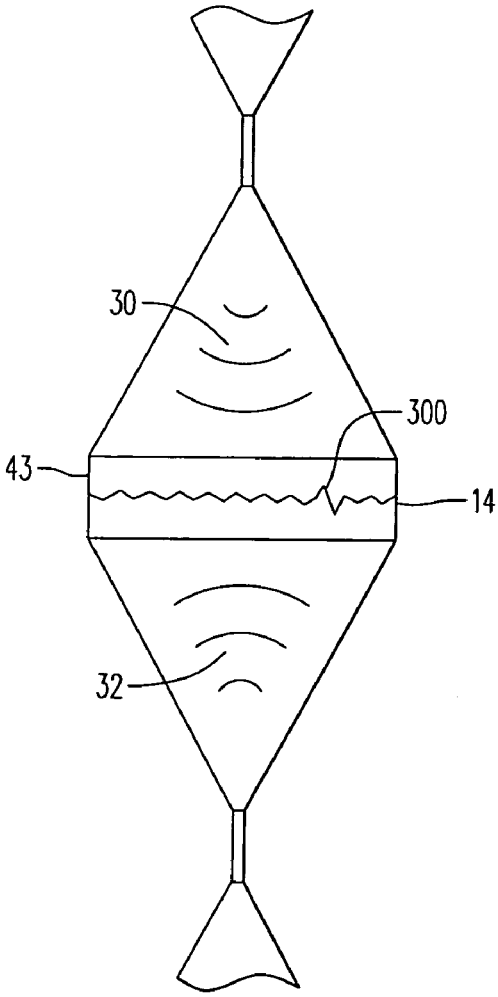
FIG. 7 is an illustration of multiple tetrahedron packages having substantially uniformly positioned tear zones.
Figure 8:
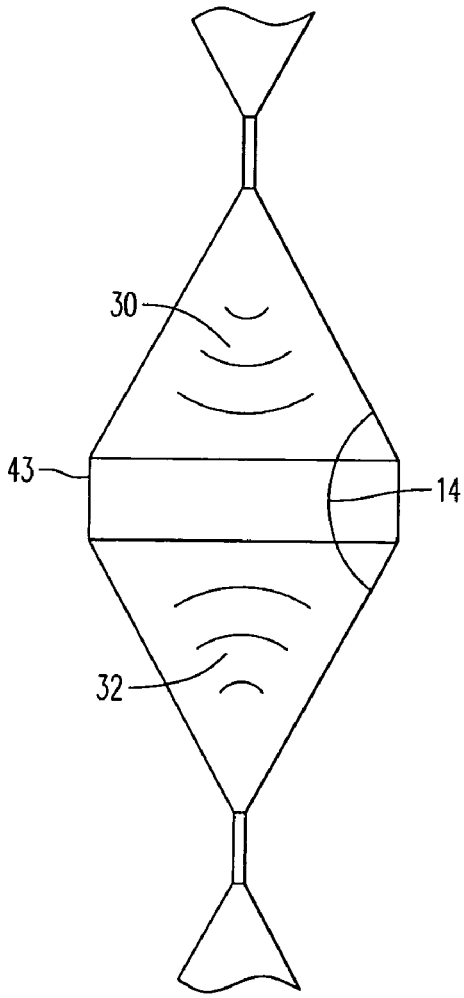
FIG. 8 is an illustration of multiple tetrahedron packages having substantially uniformly positioned tear zones.

For each first and second tetrahedron package formed, a scoring element 40 scores the second seal zone 43 so as to form a substantially uniform tear zone 14 (also shown in FIG. 7 and FIG. 8). The scoring element 40 can be a laser or a knife.

Since the first image 30 is oriented about 180° from the second image 32, once the scoring element 40 scores the second seal zone 43, the substantially uniform tear zone 14 is located at a uniform location adjacent a side edge 85 of the first tetrahedron package 50 and the second tetrahedron package 52.

Because of the location of the substantially uniform tear zone 14, the tetrahedron package is easy to open. In addition, the location of the substantially uniform tear zone 14 and the shape of the tetrahedron package allow for directional control and flow control of the product as it flows from the package during dispensing of the product.

Because of the tear zone configuration when the second seal area is laser scored, when opened at the tear zone, the arrangement also provides directional tear propagation across the corner. Preferably, the tear zone is about 10 mm to about 20 mm from the edge of the package. More preferably the tear zone is about 10 mm to about 15 mm from the edge of the package. The distance of the tear zone from the edge of the package depends upon the size of the package. If the tear zone is closer to the edge of the package, when torn, the tear will not extend through nor open the body of the package.

When the knife is used to serrate the second seal zone, the substantially uniform positioning of the notches 300 (shown in FIG. 7) allows the user to easily tear through the seal zone to open the tetrahedron package. Also, the location of the notches 300 and the tetrahedron shape of the package aids the user in completely tearing through the seal zone to open the package so as to form a directional tear propagation across the corner that aids in directional and flow control of the product from the package.

In this specification, the word "about" is often used in connection with numerical values to indicate that mathematical precision of such values is not intended. Accordingly, it is intended that where "about" is used with a numerical value, a tolerance of 5% is contemplated for that numerical value.

While the foregoing describes in detail a preferred method for making tetrahedron packages having substantially uniform tear zones with reference to a specific embodiment thereof, it will be apparent to one skilled in the art that various changes and modifications may be made to the process steps and equivalents to the process steps may be employed, which do not materially depart from the spirit and scope of the invention. Accordingly, all such changes, modifications, and equivalents that fall within the spirit and scope of the invention as defined by the appended claims are intended to be encompassed thereby.

We claim:

1. A method of making tetrahedron packages from a substrate with a foil layer, the package having substantially uniform tear zones comprising:

forming a tube from a sheet material including a first image printed at a first location and a second image printed at a second location along a sheet of material having a foil layer, such that the first image is oriented about 180° from the second image, and such that the first image and the second image are longitudinally aligned along the sheet material and adjacent to one another;

forming a first tetrahedron package including the first image and a second tetrahedron package including the second image from the tube, such that the first tetrahedron package and the second tetrahedron package are connected by a seal zone; and forming substantially uniform tear zones in the first tetrahedron package and the second tetrahedron package, wherein the substantially uniform tear zones are at the substantially same location with respect to an edge of the first tetrahedron package and an edge of the second tetrahedron package.

2. The method of claim 1, wherein the sheet material includes a plastic layer.

3. The method of claim 2, wherein said plastic layer is selected from the group consisting of oriented polypropylene film, low density polyethylene, polyethylene terephthalate and combinations thereof.

4. The method of claim 2, further including loading a condiment in the first tetrahedron package and the second tetrahedron package.

5. The method of claim 4, wherein the condiment is selected from the group consisting of ketchup, mustard, mayonnaise, relish and combinations thereof.

6. The method of claim 1, wherein the tube has a longitudinal seam.

7. The method of claim 6, wherein the longitudinal seam is a fin seal or an overlap seal.

8. The method of claim 1, wherein the substantially uniform tear zones are arcuate.

9. The method of claim 1, wherein the substantially uniform tear zone is about 8 mm to about 20 mm from the side edge of the first tetrahedron package and the second tetrahedron package.

10. The method of claim 1, wherein the substantially uniform tear zone is about 8 mm to about 15 mm from the side edge of the first tetrahedron package and the second tetrahedron package.

11. The method of claim 1, wherein a knife is used to form the substantially uniform tear zone.

12. The method of claim 11, wherein the knife has staggered teeth.

13. The method of claim 1, wherein a laser is used to form the substantially uniform tear zone.

14. A method of making tetrahedron packages having substantially uniform tear zones comprising:

forming a tube from a sheet of material including a first image printed at a first location and a second image printed at a second location along a sheet of material having a foil layer, such that the first image is oriented about 180° from the second image, and such that the first image and the second image are longitudinally aligned along the sheet material and adjacent to one another;

feeding said tube through a package forming apparatus;

forming a first seal zone in said tube below the first image to form a first sealed tube;

loading said sealed tube with a product;

forming a second seal zone in said sealed tube above a location of the product and above the first image to form a first tetrahedron package and a second sealed tube;

loading the second sealed tube with the product;

forming a third seal zone in said sealed tube above a location of the product and above the second image to form a second tetrahedron package; and scoring the second seal zone to form substantially uniform tear zones in the first tetrahedron package and the second tetrahedron package, wherein the substantially uniform tear zone of the first tetrahedron package and the tear zone of the second tetrahedron package are at the same location with respect to a side edge of the second seal zone.

15. The method of claim 14, wherein the first seal zone, the second seal zone, and the third seal zone are heat sealed.

16. The method of claim 14, wherein the product is a consumable product.

17. The method of claim 14, wherein the consumable product is selected from the group consisting of ketchup, mustard, mayonnaise, relish and combinations thereof.

18. The method of claim 14, wherein the second seal zone is oriented about 90° from the first seal zone.

19. The method of claim 14, wherein the third seal zone is oriented about 90° from the second seal zone.

20. The method of claim 14, wherein the substantially uniform tear zone of the first tetrahedron package and the substantially uniform tear zone of the second tetrahedron package are arcuate.

21. The method of claim 14, wherein the substantially uniform tear zone is about 8 mm to about 20 mm from the side edge of the first tetrahedron package and the second tetrahedron package.

22. The method of claim 14, wherein the substantially uniform tear zone is about 8 mm to about 15 mm from the side edge of the first tetrahedron package and the second tetrahedron package.

* * * * *